US007679014B2

(12) United States Patent
Heissler

(10) Patent No.: US 7,679,014 B2
(45) Date of Patent: Mar. 16, 2010

(54) PRESSURE SWITCH

(75) Inventor: Guenther Heissler, Eberdingen (DE)

(73) Assignee: SUCO Robert Scheuffele GmbH & Co. KG, Bietigheim-Bissingen (DE)

( * ) Notice: Subject to any disclaimer, the term of this patent is extended or adjusted under 35 U.S.C. 154(b) by 0 days.

(21) Appl. No.: 11/482,679

(22) Filed: Jul. 7, 2006

(65) Prior Publication Data

US 2007/0007116 A1 Jan. 11, 2007

(30) Foreign Application Priority Data

Jul. 9, 2005 (DE) ..... 10 2005 032 158

(51) Int. Cl.
*H01H 35/38* (2006.01)

(52) U.S. Cl. ..... 200/83 J

(58) Field of Classification Search ..... 200/83 J
See application file for complete search history.

(56) References Cited

U.S. PATENT DOCUMENTS

| | | | | |
|---|---|---|---|---|
| 2,356,177 | A | 8/1944 | Pierson | |
| 2,636,093 | A | 4/1953 | Clark | |
| 3,119,910 | A | 1/1964 | Meisenheimer | |
| 3,239,622 | A * | 3/1966 | Clason | 200/81.9 R |
| 4,882,459 | A | 11/1989 | Edwards | |
| 5,672,049 | A * | 9/1997 | Ciurlo | 417/44.1 |
| 7,038,151 | B2 * | 5/2006 | Amaduzzi | 200/82 R |
| 2005/0279413 | A1 * | 12/2005 | Shen | 137/554 |

FOREIGN PATENT DOCUMENTS

| | | |
|---|---|---|
| DE | 1 697 235 | 4/1955 |
| DE | 1 219 928 | 10/1973 |
| DE | 2 219 933 | 10/1973 |
| DE | 36 31 304 | 3/1988 |
| DE | 43 24 348 | 1/1994 |

* cited by examiner

*Primary Examiner*—Renee S Luebke
*Assistant Examiner*—Lheiren Mae A Anglo
(74) *Attorney, Agent, or Firm*—Michael J. Striker

(57) ABSTRACT

In a pressure switch with a housing in which a plunger element is located that is movable against a spring force of a first elastic element—contacts being located directly or indirectly on the plunger element, and the first elastic element being located on the side of the plunger element facing toward or away from the media connection—a second elastic element is provided, against the spring force of which the plunger element can be moved. As a result, the pressure switch can be used for pressures>200 bar in situations where overall dimensions are small.

5 Claims, 2 Drawing Sheets

Fig. 1
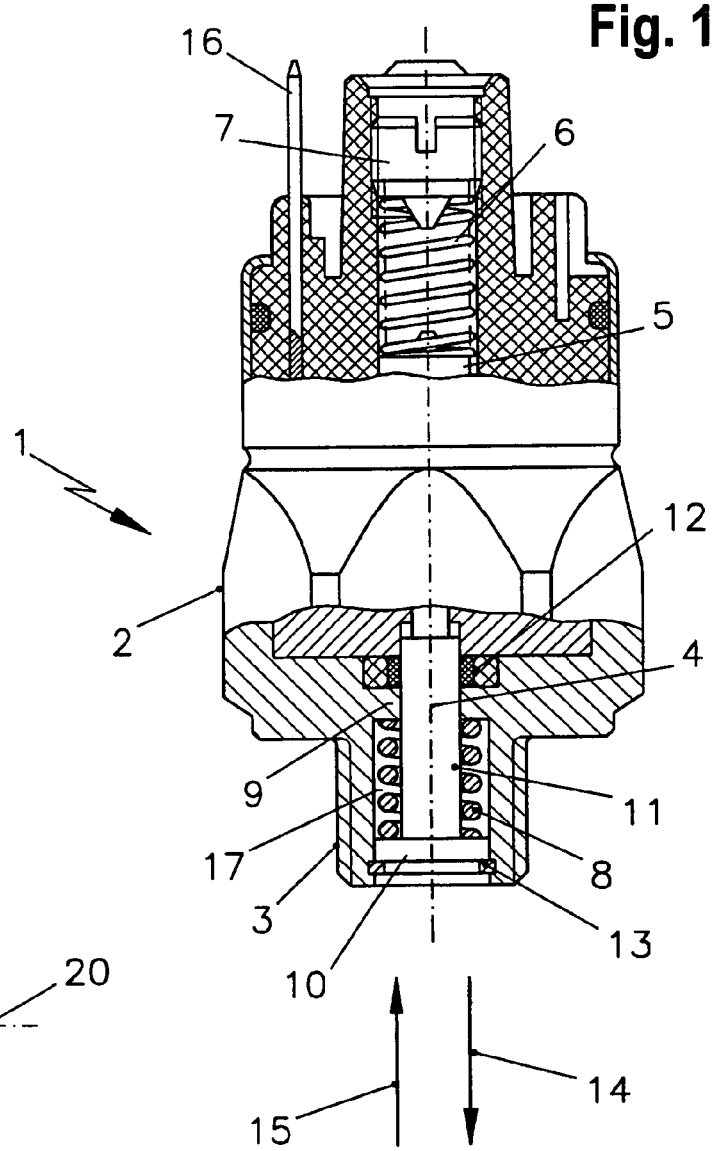
Fig. 2b
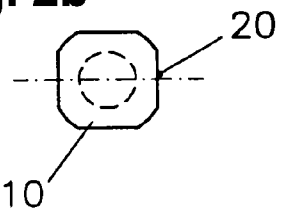
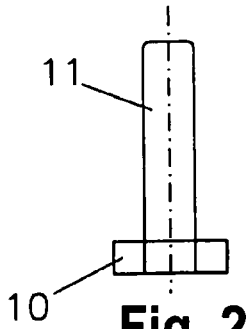
Fig. 2a

PRESSURE SWITCH

CROSS-REFERENCE TO A RELATED APPLIACTION

The invention described and claimed hereinbelow is also described in German Patent Application DE 10 2005 032 158.5 filed on Jul. 9, 2005. This German Patent Application, whose subject matter is incorporated here by reference, provides the basis for a claim of priority of invention under 35 U.S.C. 119(a)-(d).

BACKGROUND OF THE INVENTION

The present invention generally relates to pressure switches.

More particularly the present invention relates to a pressure switch with a housing in which a plunger element that is movable against a spring force of a first elastic element is located, contacts being located directly or indirectly on the plunger element, and the first elastic element being located on the side of the plunger element facing toward or away from a media connection.

Pressure switches are known with which a spring is located in a housing, it being possible to move a plunger—on which contacts are provided—against the return force of the spring. The spring can be used to set the pressure at which the switch state changes. There is a demand for pressure switches that are actuated at higher pressures. In particular, there is a demand for pressure switches that are actuated at pressures>200 bar. It would also be feasible to use stronger springs with the known pressure switch. This is not possible given the amount of installation space available, however. Entirely new pressure switches would have to be designed that have a larger housing in order to acommodate the stronger springs.

SUMMARY OF THE INVENTION

The object of the present invention, therefore, is to refine a pressure switch such that high pressures are required to actuate the switching function when a small housing is provided.

This object is attained in an effective manner according to the present invention by providing a second elastic element, against the spring force of which the plunger element is movable.

Via this measure it is possible to use the pressure switch for higher pressures, in particular in the range between 200 and 400 bar, it being possible to keep the dimensions of the pressure switch as small as they are with pressure switches designed for use with pressures below 200 bar.

Depending on their application, the pressure switches can be designed as normally open contacts, changeover contacts, or normally closed contacts. They can be designed as plunger-actuated pressure switches or diaphragm switches. They are used, in particular, to carry out an electric switching procedure as a function of a media pressure and/or when a certain media pressure is reached or fallen below. Gasses and fluids, in particular, can be used as the medium. The pressure switches can be connected to a related media line. The spring forces associated with the pressure switch according to the present invention are cumulative, thereby enabling the pressure to be used with higher media pressures.

Particularly preferably, the second elastic element is located on the side of the plunger element facing the media connection.

It is therefore possible to position an elastic element axially on both sides of the plunger element. The elastic elements work in the same direction. One of the elastic elements pushes the plunger element, and the other elastic element pulls the plunger element. The piston element can be designed as a single-component part or a multiple-component part.

The elastic elements can be realized in a particularly simple manner when the first and/or second elastic element are designed as springs.

With an advantageous configuration of the present invention, it can be provided that the plunger element includes a shoulder on its end where the media connection is located, the second elastic element bearing against the shoulder.

A large contact surface for the second elastic element is obtained when the shoulder has a plate-shaped configuration. It is particularly preferrable for the plate-shaped configuration to abut a shank of the plunger element that passes through the second elastic element. This allows the second plastic element to be positioned in a space-saving manner.

In this context, it is particularly preferrable for one end of the second elastic element to bear against a housing stop.

With an advantageous embodiment, it can be provided that the second elastic element is preloaded when the pressure switch is not actuated. The second elastic element is preferably used to pull the plunger element in the direction of the media line. The preload can be used to set the force with which the plunger element is pulled by the second elastic element in the direction of the media line.

With a particularly preferred embodiment, pressure-compensation means can be provided on the plunger element to offset the pressure between a media line to be connected and the space provided for the second elastic element. The pressure-compensation means can be advantageously designed as openings in the shoulder of the plunger element, or as pressure-compensation surfaces on the shoulder of the plunger element.

By providing pressure-compensation means, it can be ensured that it be necessary only to overcome the pressure set via the spring force of the elastic elements in order to trigger the pressure switch. Any medium located in the space provided for the second elastic element therefore does not affect the triggering pressure of the pressure switch. The functional reliability of the pressure switch is ensured as a result.

It is particularly advantageous when the space for the second elastic element is provided in a media line connection. This eliminates the need for additional installation space. An existing housing can be used.

The triggering pressure can be set in a particularly simple manner when the spring force of the first and/or second elastic element is adjustable, in particular via an adjustment screw. The first elastic element preferably bears against an adjustment screw, and the second elastic element is preloaded to a nominal force.

Further features and advantages of the present invention result from the detailed description of an exemplary embodiment of the invention presented below with reference to the figures in the drawing, which shows the details that are essential to the present invention. Further features and advantages of the present invention also result from the claims. The individual features can be realized individually, or they can be combined in any possible manner in different variations of the present invention.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 shows a partial cross section of a pressure switch, according to the present invention;

FIG. 2*a* shows a side top view of a plunger element, according to the present invention;

FIG. 2*b* shows a top view of the plunger element from below, according to the present invention.

DESCRIPTION OF THE PREFERRED EMBODIMENTS

Figure 3:
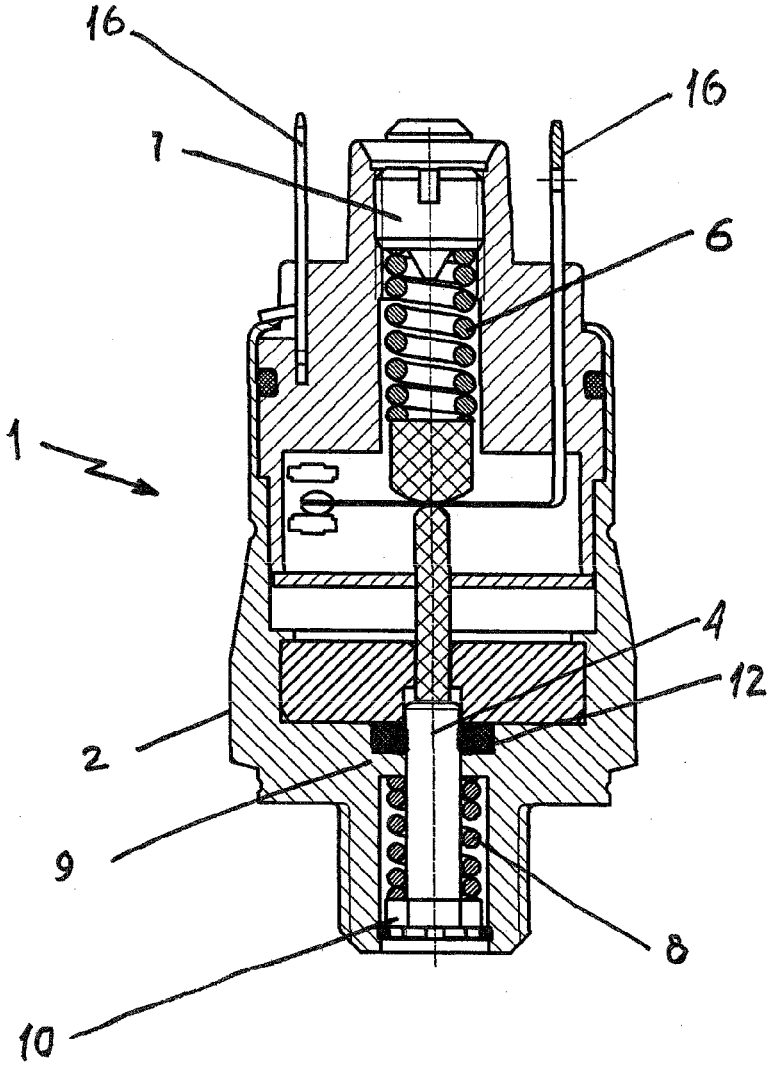
FIG. 3 shows a partial cross section of the pressure switch, according to the present invention, in a different position.

Pressure switch 1 shown in FIG. 1 includes a housing 2 with a media connection 3. A plunger element 4 designed as a stepped plunger is movably located in housing 2. End 5 of plunger element 4 facing away from media connection 3 interacts with a first elastic element 6, which is designed as a spring. First elastic element 6 bears against an adjustment screw 7 that can be screwed into housing 2.

Second elastic element 8, which is also designed as a spring, is located on the end of plunger element 4 where the media connection is located. Second elastic element 8 bears against a housing stop 9 and against a stop 10 that has a plate-shaped configuration. Second elastic element 8 is located on a shank 11 of plunger element 2. Not-shown contacts are located above a seal 12. A snap ring 13 is provided to prevent plunger element 4 from falling out.

Second elastic element 8 is preloaded and tries to move plunger element 4 in arrow-head direction 14. When a medium acts on pressure switch 1 in arrow-head direction 15, plunger element 4 is moved against the spring forces of elastic elements 6, 8 in arrow-head direction 15. The contacts inside housing 2 are lengthened as a result and, depending on the design of the contacts, a normally-open, normally-closed or changeover contact function of pressure switch 1 is realized. Fixed contacts connected with terminals 16 in an electrically conductive manner can be assigned to the contacts capable of being moved by plunger element 4.

When pressure switch 1 is actuated, shoulder 10 in installation space 17 of second elastic element 8 is lengthened. Pressure-compensation means are provided to allow medium to be displaced from installation space 17 and thereby ensure that any medium located in installation space 17 does not hinder the movement of plunger element 4.

Plunger element 4 is shown in FIG. 2*a*. Plate-shaped shoulder 10 is a step against which second elastic element 8 can bear, second elastic element 8 being located on shank 11.

As shown in FIG. 2*b*, shoulder 10—which is the pressure-compensation means—includes pressure-compensation surfaces 20, thereby resulting in openings between shoulder 10 and, e.g., circular, installation space 17, through which medium can flow between a media line and installation space 17.

It will be understood that each of the elements described above, or two or more together, may also find a useful application in other types of constructions differing from the types described above.

While the invention has been illustrated and described as embodied in a pressure switch, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. A pressure switch, comprising a housing;

a plunger element located in said housing and providing contacting; a first elastic element providing a spring force against which said plunger element is movable; contacts provided on said plunger element, said first elastic element being located on a side of said plunger element selected from the group consisting of a side facing toward a media connection and a side facing away from the media connection; and a second elastic element providing a spring force against which said plunger element is movable, wherein said plunger element has an end where the media connection is located and includes a shoulder at said end, said second elastic element bearing against said shoulder.

2. A pressure switch as defined in claim 1, wherein said shoulder of said plunger element has a plate-shaped configuration.

3. A pressure switch as defined in claim 2, wherein said plunger element has a shank extending through said second elastic element, said plate-shaped shoulder of said plunger element abutting against said shank of said plunger element.

4. A pressure switch, comprising a housing: a plunger element located in said housing; a first elastic element providing a spring force against which said plunger element is movable; contacts provided on said plunger element, said first elastic element being located on a side of said plunger element selected from the group consisting of a side facing toward a media connection and a side facing away from the media connection; and a second elastic element providing a spring force against which said plunger element is movable, said first and second elastic elements being configured so that said spring forces of said first and second elastic elements, against which said plunger element is movable, are cumulative; and further comprising pressure-compensating means provided on said plunger element for offsetting a pressure between a media line to be connected and a space provided for said second elastic element.

5. A pressure switch as defined in claim 4, wherein said pressure-compensation means are configured as openings in pressure-compensation surfaces on a shoulder of said plunger element.

* * * * *